United States Patent [19]

Hürlemann et al.

[11] Patent Number: 4,840,108

[45] Date of Patent: Jun. 20, 1989

[54] APPARATUS FOR THE INFEED OF AMMUNITION FROM AN AMMUNITION CONTAINER TO AN AUTOMATIC FIRING WEAPON

[75] Inventors: Ernst Hürlemann; Kurt Müller; Bruno Ruppen, all of Zurich, Switzerland

[73] Assignee: Werkzeugmaschinenfabrick Oerlikon-Bührle AG, Zurich, Switzerland

[21] Appl. No.: 184,608

[22] Filed: Apr. 21, 1988

[30] Foreign Application Priority Data

May 8, 1987 [CH] Switzerland ..... 01768/87

[51] Int. Cl.[4] ..... F41F 9/02

[52] U.S. Cl. ..... 89/33.14; 89/361.3

[58] Field of Search ..... 89/33.14, 33.16, 36.08, 89/33.04, 33.2, 36.13, 33.1

[56] References Cited

U.S. PATENT DOCUMENTS

| | | | |
|---|---|---|---|
| 2,951,422 | 9/1960 | Bobkowski | 89/33.14 |
| 3,029,706 | 4/1962 | Wey | 89/33.14 |
| 3,045,553 | 7/1962 | Mösle | 89/33.16 |
| 3,170,372 | 2/1965 | Stanton | 89/33.16 |
| 3,437,005 | 4/1969 | Trumper | 89/33.02 |
| 4,674,392 | 6/1987 | Beckmann | 89/33.04 |
| 4,781,100 | 11/1988 | Baldwin | 89/33.04 |

FOREIGN PATENT DOCUMENTS

| | | |
|---|---|---|
| 1026201 | 3/1958 | Fed. Rep. of Germany . |
| 1112427 | 8/1961 | Fed. Rep. of Germany . |
| 2024672 | 11/1970 | Fed. Rep. of Germany . |
| 2305832 | 8/1974 | Fed. Rep. of Germany . |

*Primary Examiner*—Deborah L. Kyle
*Assistant Examiner*—Michael J. Carone
*Attorney, Agent, or Firm*—Werner W. Kleeman

[57] ABSTRACT

The ammunition infeed apparatus for an automatic firing weapon is constructed as simple and operationally reliable as possible. This ammunition infeed apparatus comprises an ammunition container filled with a plurality of ammunition loading or cartridge clips. The ammunition container rotates with the firing weapon about the azimuth axis. There is also provided a device for the ejection of the full ammunition loading clips from the ammunition container, a device for the extraction or stripping of the cartridges or ammunition from the ammunition loading clips. This extraction or stripping device comprises an endless conveyor band. Also provided is a flexible endless chain for the transport of the ammunition or cartridges stripped from the ammunition loading clips to the firing weapon.

6 Claims, 4 Drawing Sheets

FIG. 1
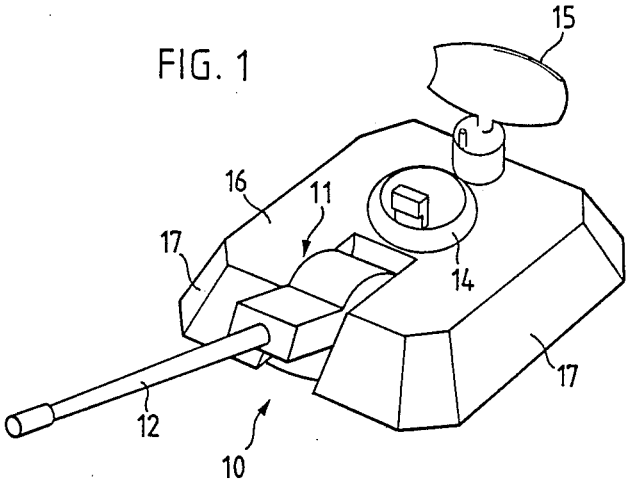
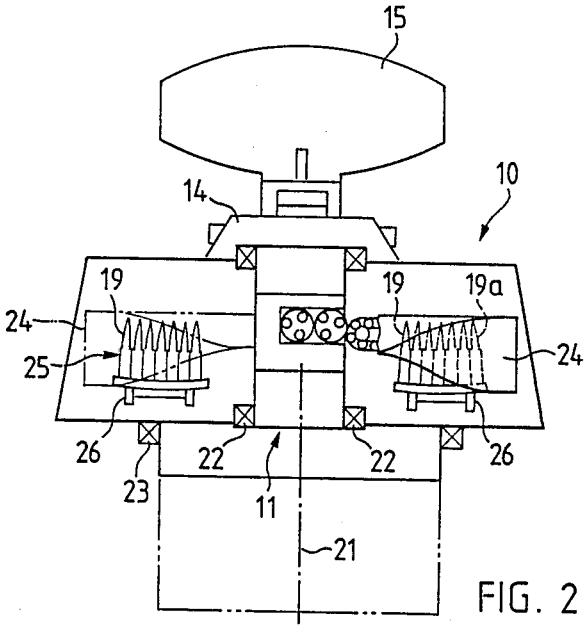
FIG. 2

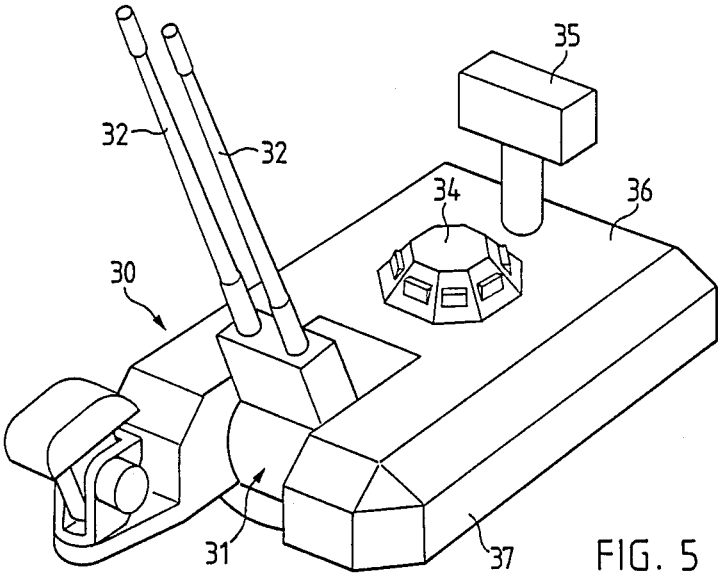
FIG. 5
FIG. 6
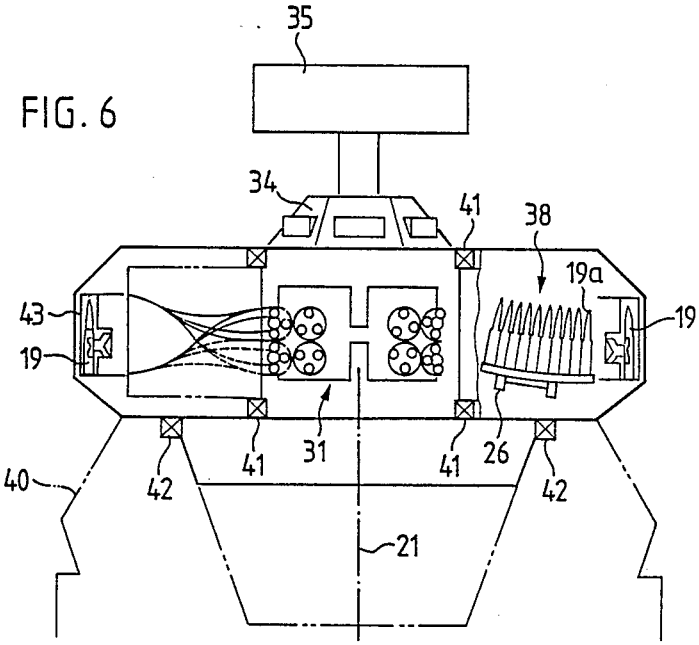

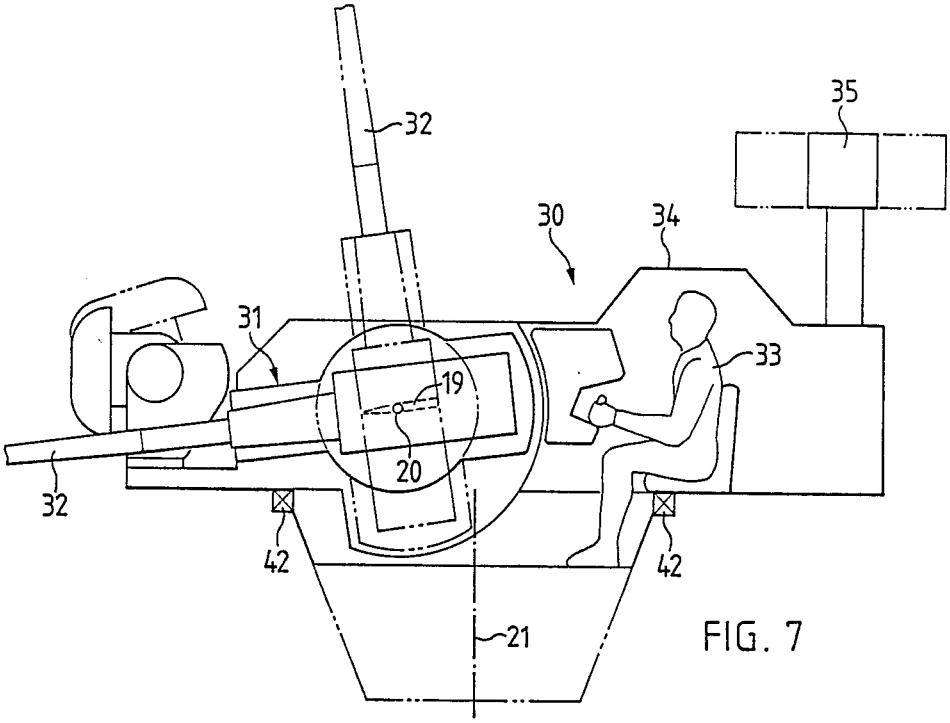
FIG. 7
FIG. 8
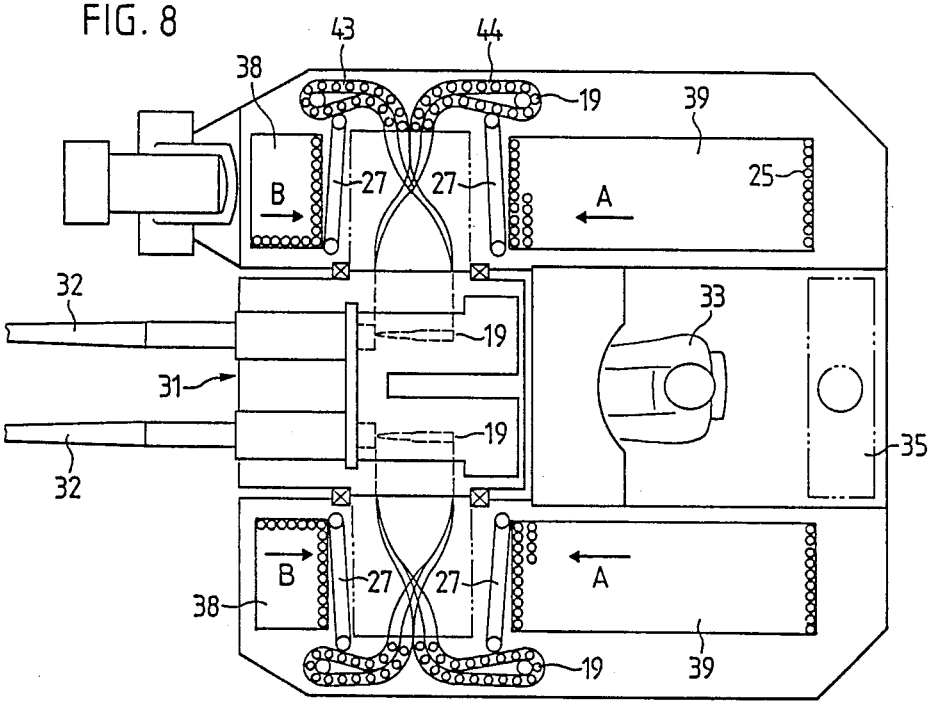

APPARATUS FOR THE INFEED OF AMMUNITION FROM AN AMMUNITION CONTAINER TO AN AUTOMATIC FIRING WEAPON

BACKGROUND OF THE INVENTION

The present invention relates to a new and improved construction of an apparatus for the infeed or delivery of ammunition or ammunition rounds, herein sometimes referred to as cartridges, from an ammunition container to an automatic firing weapon. In particular, although not always necessarily, two types of ammunition or ordnance should be delivered to the automatic firing weapon.

In a heretofore known ammunition infeed apparatus of the aforementioned general type, as disclosed for instance in the commonly assigned Swiss Pat. No. 379,969, granted July 15, 1964 and the cognate German Pat. No. 1,112,427, published Aug. 3,1961 as well as the corresponding U.S. Pat. No. 3,045,553, granted July 24, 1962, groups or sets of cartridges, grouped together in ammunition loading or cartridge clips, are stacked in superimposed relationship in an ammunition magazine or container for automatic firing weapons. The lowermost cartridge group or set is supported upon a movable support surface. In this cartridge or ammunition magazine, there is provided a conveyor device which, during firing of the ammunition in the individual loading clips, shifts perpendicular to the individual layers of the superimposed cartridge groups or sets towards the support surface. This support surface is formed from the helical surfaces of two guide surfaces which are in drive connection with the conveyor device located thereabove.

According to another state of the art ammunition infeed device of this type, as disclosed for instance in the likewise commonly assigned German Pat. No. 1,026,201, published Mar. 13, 1958, there is provided a rotatable drum magazine or container. This cartridge infeed apparatus further comprises a conveyor device which extracts or strips the cartridges out of the drum magazine and is arranged upon a stationary base plate. This conveyor device is structured as an endless revolving chain which is provided with entrainment members. This chain is in drive connection with the rotatable drum magazine and assumes an inclined position. This inclined position of the chain coincides with the resultant movement direction which is the result of, on the one hand, the rotational motion or movement of the drum magazine and, on the other hand, the movement of the cartridges in the chamber or compartment which is in the process of being emptied.

According to a further heretofore known ammunition or cartridge infeed device of this type, as disclosed in U.S. Pat. No. 3,437,005, granted Apr. 8, 1969, a flexible transport band for the transport of the ammunition rounds or cartridges is arranged between a rapid firing weapon, in particular a Gatling-gun, and a stationary ammunition container. This transport band is both bendable and twistable in order to be able to take up the relative movement between the firing weapon and the ammunition container. This transport band contains an outer guide and an inner helical transport element for the transport of the cartridges from the ammunition container to the firing weapon.

SUMMARY OF THE INVENTION

It is a primary object of the present invention to provide an improved apparatus for the infeed of ammunition or cartridges from an ammunition container to an automatic firing weapon in a manner not associated with certain shortcomings of the prior art constructions.

Another and more specific object of the invention relates to an ammunition infeed apparatus wherein the ammunition container or magazine moves in conjunction with the firing weapon about the azimuth axis, but such ammunition container or magazine does not move during elevation of the firing weapon.

A further noteworthy object of the present invention is directed to a new and improved construction of ammunition infeed apparatus wherein the lengthwise axis of the ammunition rounds or cartridges are disposed in an upright position or orientation, particularly in a substantially vertical disposition, and the tips of the ammunition rounds or cartridges either can be directed upwardly or downwardly.

Yet a further significant object of the present invention aims at the provision of an improved construction of ammunition infeed apparatus which is relatively simple in design, highly reliable in operation, is not positionally shifted during elevation of the firing weapon, and affords enhanced flexibility in terms of the disposition of the ammunition rounds or cartridges within the ammunition container or magazine.

A further significant object of the present invention aims at the provision of an improved construction of ammunition infeed apparatus which appreciably simplifies the infeed of the ammunition rounds or cartridges from the ammunition container or magazine to the firing weapon.

Still a further important object of the present invention is to devise an ammunition infeed apparatus for feeding ammunition rounds or cartridges in a reliable fashion from an ammunition container or magazine to the firing weapon, wherein the relatively large mass or weight of the ammunition container or magazine need not be pivoted or moved about the elevation axis of the firing weapon. Now in order to implement these and still further objects of the invention, which will become more readily apparent as the description proceeds, the ammunition infeed apparatus of the present development is manifested, among other things, by the features that there is provided an ammunition container which is filled with a number of loading clips for the rounds of ammunition or cartridges. This ammunition container or magazine rotates in conjunction with the firing weapon about the azimuth axis of the firing weapon. At each loading clip or the like there is provided a number of ammunition rounds or cartridges. There is also provided a device for displacing the loaded or full loading clips out of the ammunition container or magazine. Furthermore, an extraction or stripping device serves to extract or strip the ammunition rounds or cartridges from the loading clips. This ammunition extraction or stripping device comprises an endless conveyor band or belt or equivalent structure which is arranged at an inclination in relation to the loading clips, so that there can be accomplished inclined extraction or stripping of the ammunition rounds or cartridges. There is also provided a flexible endless chain or chain member which can be twisted through an angle of at least 90°, preferably at least 100°, and serving for transport of the ammunition rounds or cartridges which have been extracted or stripped from the loading clips to the firing weapon. It is preferable if all of the devices or elements are provided twice since in this way there can be preferably infed to the firing weapon two different types of ammunition or cartridges. The ammunition rounds or cartridges are arranged in an upright disposition, preferably substantially vertically, in the associated ammunition container or magazine. As noted previously, the cartridge tips can be directed either upwardly or downwardly.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a perspective illustration of an armored turret according to a first exemplary embodiment of the invention;

FIG. 2 is a cross-sectional view of the armored turret depicted in FIG. 1.

FIG. 5 is a perspective illustration through an armored turret according to a second exemplary embodiment of the present invention;

FIG. 6 is a cross-sectional view of the armored turret depicted in FIG. 5;

FIG. 7 is a longitudinal sectional view of the armored turret depicted in FIG. 5; and FIG. 8 is a top plan view of the armored turret depicted in FIG. 5.

DETAILED DESCRIPTION OF THE PREFERRED EMBODIMENTS

Figure 3:
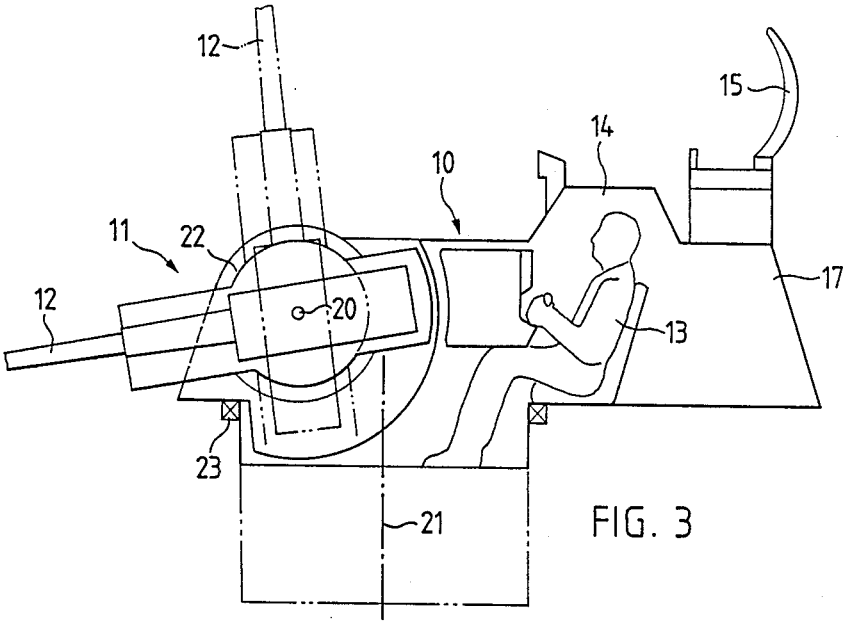
FIG. 3 is a longitudinal sectional view of the armored turret depicted in FIG. 1.
Figure 4:
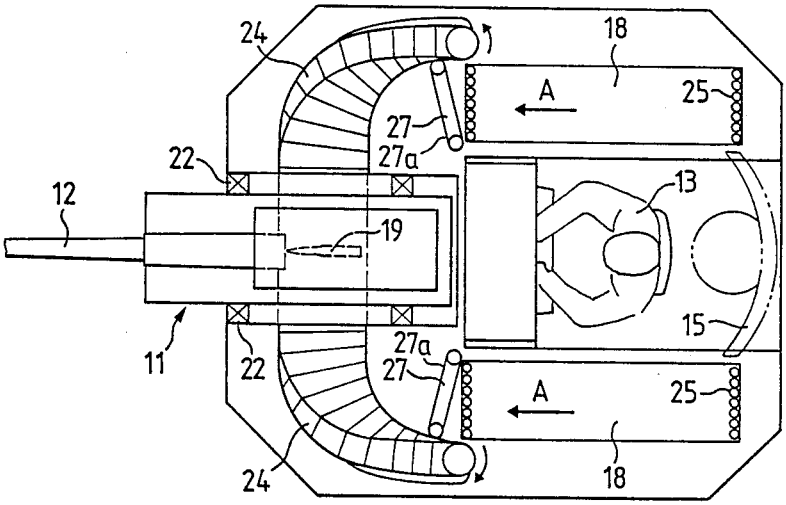
FIG. 4 is a top plan view of the armored turret depicted in FIG. 1.

Describing now the drawings, it is to be understood that for purposes of simplification thereof only enough of the construction of the armored turret or mount arrangement has been depicted therein as needed for those skilled in the art to readily understand the underlying principles and concepts of the present invention. Turning attention now specifically to FIG. 1, an automatic firing weapon 11 is located at the front and substantially centrally of a rotatable armored turret or mount arrangement 10. The automatic firing weapon 11 is here shown as comprising a single weapon barrel 12. As shown in FIG. 3 and 4, the gunner 13 is located behind the automatic firing weapon 11 in a dome or cupola 14. Installed behind the dome or cupola 14 is a suitable radar device 15. To both sides of the dome or cupola 14 there is mounted beneath armored plates or plating 16 and 17 a respective ammunition container or magazine 18, as will be particularly evident by referring to FIGS. 2 and 4.

According to the showing of FIG. 2, the ammunition rounds or cartridges 19 are arranged within each ammunition container 18 in an upright disposition, here shown substantially vertically oriented to both sides of the automatic firing weapon 11. Here the ammunition rounds or cartridges 19 are shown with the tips **19*a* upwardly directed. Of course, the ammunition rounds or cartridges 19 also could be arranged in the associated ammunition container 18 such that the tips 19*a* are downwardly directed. In the exemplary embodiment under discussion there have been shown, purely by way of example and not limitation, seven ammunition rounds or cartridges 19 arranged in an associated loading or ammunition or cartridge clip 25 or equivalent structure. According to the illustration of FIG. 3 the automatic firing weapon 11 is shown to be pivotable through an angle of approximately 90° about an elevation axis 20. The uppermost pivoted position of this automatic firing weapon 11 has been depicted by a chain-dot illustration and the lowermost position of such automatic firing weapon 11 by the full line illustration. On the other hand, both of the ammunition containers or magazines 18 are not mounted in the armored turret 10 so as to be pivotable about the elevation axis 20 of the automatic firing weapon 11**.

As will be apparent from the illustration of FIG. 2, in order to be able to train the automatic firing weapon 11 in azimuth the armored turret 10 is pivotably mounted about a substantially vertical azimuth axis 21 in an associated conventional and thus not here illustrated vehicle, such as an armored vehicle or tank purely by way of example. For the elevation of the automatic firing weapon 11 the latter is appropriately mounted in roller bearings 22 or equivalent bearing structure, as shown in FIGS. 2 to 4. For the rotation of the automatic firing weapon 11 in azimuth the armored turret 10 is pivotably mounted in a roller bearing 23 or equivalent structure, as indicated in FIGS. 2 and 3. During the rotation of the armored turret 10 about the azimuth axis 21 the ammunition containers or magazines 18 also move therewith. During the pivoting of the automatic firing weapon 11 about the elevation axis 20 these ammunition containers or magazines 18 are not, however, able to participate in such pivotal motion. To ensure that the infeed of the ammunition rounds or cartridges 19 from the ammunition containers 18 is possible in every position of the automatic firing weapon 11, there is provided a suitable flexible ammunition channel 24 leading from each ammunition container 18 to the automatic firing weapon 11. Such flexible ammunition channels 24 are well known in this technology, for instance could be of the type as disclosed in the aforementioned U.S. Pat. No. 3,437,005.

According to the showing of FIG. 4, the individual ammunition loading or cartridge clips 25, each for instance containing seven ammunition rounds or cartridges 19, are displaced or shifted in the direction of the arrow A (FIG. 4) by a conventional conveyor device 26 (FIG. 2) towards an extraction or stripping device 27 (FIG. 4). This ammunition or cartridge extraction or stripping device 27 essentially comprises an endless conveyor band or belt **27*a* which is disposed at an inclination with respect to the loading clips 25, as evident from FIG. 4, and at which there are secured two suitable entrainment members which in conventional manner extract or strip the ammunition rounds or cartridges 19 out of the loading clips 25 and transport the stripped ammunition rounds or cartridges to the related flexible ammunition channel 24 or the like. In each such flexible ammunition channel 24 there is located a further endless, further flexible conveyor band or belt which transports the ammunition rounds or cartridges in the associated ammunition channel 24 to the automatic firing weapon 11**. Suitable structure for accomplishing such ammunition stripping function likewise is well known in this technology and since details thereof are not important for understanding the principles of the invention, reference may be made, for instance, to the aforementioned U.S. Pat. No. 3,045,553, the disclosure of which is incorporated herein by reference.

In order that, for instance, the automatic firing weapon 11 can have infed thereto two different types of ammunition rounds or cartridges in the right-hand side ammunition container or magazine 18 of the illustration of FIG. 2 there is located a different type of ammunition than in the left-hand side depicted ammunition container or magazine 18.

Turning attention now to FIGS. 5 to 8, there is depicted therein a second exemplary embodiment of ammunition infeed apparatus. With reference specifically to FIG. 5, in this second exemplary embodiment there is located at the armored turret or mount arrangement 30, at the front side thereof at its central region, an automatic firing weapon 31 which here contains two or twin weapon barrels 32. By specifically referring to FIGS. 7 and 8 it will be observed that behind the automatic firing weapon 31 there is located the gunner 33 in a dome or cupola 34 and behind this dome or cupola 34 there is installed a suitable radar device 35. Beneath armored plates or plating 36 and 37 there are arranged at each side of the dome or cupola 34 two ammunition containers or magazines 38 and 39, as particularly evident by referring to FIG.8.

As shown in FIG. 6 also with this second exemplary embodiment of the invention, the ammunition rounds or cartridges 19, just as was the case for the first exemplary embodiment, are arranged in an upright disposition, here essentially vertically, in the ammunition containers 38 and 39 to both sides of the automatic firing weapon 31 and, by way of example, with the cartridge tips 19*a* upwardly directed. Also in this case the ammunition rounds or cartridges 19 could be disposed in the related ammunition containers 38 and 39 such that the cartridge tips 19*a* are downwardly directed. By way of example there have been shown in FIGS. 6 and 8 ten ammunition rounds or cartridges 19 in an associated loading or ammunition clip 25 or equivalent structure.

According to the showing of FIG. 7 both of the weapon barrels 32 of the automatic firing weapon 31 are pivotable about an elevational axis 20 through an angle of approximately 90°. Again the uppermost position of the twin barrels 32 of the automatic firing weapon 31 has been indicated by chain-dot lines and the lowermost position thereof by full or solid lines. The four ammunition containers or magazines 38 and 39 are here also not pivotably mounted in the armored turret 30 about the elevation axis 20. The armored turret 30 or the like is again likewise pivotably mounted upon a suitable vehicle 40 so as to be rotatable about a substantially vertical azimuth axis 21, as generally indicated in FIG. 6.

For the elevational movements the automatic firing weapon 31, as depicted in FIGS. 6 and 7, is mounted in roller bearings 41 or equivalent bearing structure. For the rotation in azimuth the armored turret 30 is pivotably mounted in a roller bearing structure 42, again as shown in FIGS. 6 and 7. Upon rotation of the armored turret 30 about the azimuth axis 21 the four ammunition containers or magazines 38 and 39 also move together with the automatic firing weapon 31 about such azimuth axis 21. Upon pivoting the automatic firing weapon 31 about the elevation axis 20 these ammunition containers or magazines 38 and 39 cannot, however, participate in such pivotal motion. So that the infeed of the ammunition rounds or cartridges 19 from the four ammunition containers 38 and 39 is ensured in every position of the twin weapon barrels 32 of the automatic firing weapon 31 there are provided four flexible ammunition channels 43, 44, 45 and 46 which extend from the associated ammunition containers 38 and 39 to the associated twin barrels 32 of the automatic firing weapon 31.

Here also and as depicted in FIG. 8 the individual loading or ammunition or cartridges clips 25 together with the ten ammunition rounds or cartridges 19 provided for each such loading clip 25, are shifted or displaced in the direction of the arrows A or B, as the case by be, by a conventional conveyor or feed device 26 (FIG. 6) towards a suitable cartridge extraction or stripping device 27 (FIG. 8). This ammunition or cartridge extraction or stripping device 27 here also may be constructed in the manner observed during discussion of the first exemplary embodiment described with reference to FIGS. 1 to 4, and hence need not here be further considered. In order that the twin barrels 32 of the automatic firing weapon 31 can be fed with two different types of ammunition or ordnance there is located in the front ammunition container or magazine 38 a different type of ammunition or ordnace than in the rear ammunition container or magazine 39.

While there are shown and described present preferred embodiments of the invention, it is to be distinctly understood that the invention is not limited thereto, but may be otherwise variously embodied and practiced within the scope of the following claims.

Accordiingly, what we claim is:

1. An apparatus for the infeed of ammunition from an ammunition container to an automatic firing weapon, comprising:

an ammunition container;

a plurality of loading clips for ammunition provided for the ammunition container;

each loading clip containing a predetermine number of cartridges;

means mounting said ammunition container for rotation in conjunction with the automatic firing weapon about a predetermine azimuth axis;

a device for displacing the loaded loading clips out of the ammunition container;

an extraction device for stripping the cartridges out of the loading clips;

said extraction device comprising an endless conveyor band which is arranged at an inclination in relation to the loading clips; and a flexible endless chain which can be twisted through an angle of at least 90° for the transport of the cartridges from the endless conveyor band which have been stripped out of the loading clips to the firing weapon.

2. The apparatus as defined in claim 1, wherein:

said flexible endless chain can be twisted through an angle of at least 100°.

3. The apparatus as defined in claim 1, further including:

at least two said ammunition containers each containing therein loading clips;

at least two said devices for the displacement of the loading clips out of the related ammunition container;

at least two said extraction devices for stripping the cartridges out of the loading clips; and at least two said flexible endless chains for the transport of the stripped cartridges to the automatic firing weapon, whereby two different types of ammunition can be infed to the automatic firing weapon.

4. The apparatus as defined in claim 1, wherein:

said cartridges are arranged substantially in upright disposition in the ammunition container.

5. The apparatus as defined in claim 4, wherein:

said cartridges are arranged in essentially vertical disposition in the ammunition container.

6. An apparatus for the infeed of ammunition from an ammunition container to an automatic firing weapon, comprising:

an ammunition container;

a plurality of loading clips for ammunition provided for the ammunition container;

means mounting said ammunition container only for rotation in conjunction with the automatic firing weapon about a predeterminate azimuth axis but not for movement about an elevation axis of the automatic firing weapon;

a device for displacing the loaded loading clips towards an extraction device;

an extraction device for extracting the cartridges from the loading clips;

said extraction device comprising an endless conveyor band which is arranged at an inclination in relation to the loading clips; and a flexible endless chain which can be twisted through an angle of at least 90° for the transport of the cartridges from the endless conveyor band which have been stripped out of the loading clips to the firing weapon.

* * * * *

UNITED STATES PATENT AND TRADEMARK OFFICE

CERTIFICATE OF CORRECTION

PATENT NO. : 4,840,108

DATED : June 20, 1989

INVENTOR(S) : ERNST HÜRLEMANN et al

It is certified that error appears in the above-identified patent and that said Letters Patent is hereby corrected as shown below:

Column 6, line 37, after "a" please delete "predetermine" and insert --predeterminate--

Column 6, line 41, after "a" please delete "predetermine" and insert --predeterminate--

Signed and Sealed this

Thirteenth Day of March, 1990

*Attest:*

JEFFREY M. SAMUELS

*Attesting Officer*

*Acting Commissioner of Patents and Trademarks*